US009468830B2

(12) United States Patent
Paulson

(10) Patent No.: US 9,468,830 B2
(45) Date of Patent: Oct. 18, 2016

(54) GOLF SWING TRAINING CLUB

(71) Applicant: Michael Paulson, Edmonton (CA)

(72) Inventor: Michael Paulson, Edmonton (CA)

( * ) Notice: Subject to any disclaimer, the term of this patent is extended or adjusted under 35 U.S.C. 154(b) by 173 days.

(21) Appl. No.: 14/384,798

(22) PCT Filed: Mar. 12, 2013

(86) PCT No.: PCT/CA2013/050182
§ 371 (c)(1),
(2) Date: Sep. 12, 2014

(87) PCT Pub. No.: WO2013/134872
PCT Pub. Date: Sep. 19, 2013

(65) Prior Publication Data

US 2015/0273308 A1 Oct. 1, 2015

Related U.S. Application Data

(60) Provisional application No. 61/610,542, filed on Mar. 14, 2012.

(51) Int. Cl.
*A63B 69/36* (2006.01)
*A63B 53/14* (2015.01)

(52) U.S. Cl.
CPC ..... *A63B 69/36* (2013.01); *A63B 60/08* (2015.10); *A63B 60/10* (2015.10); *A63B 60/12* (2015.10); *A63B 60/20* (2015.10); *A63B 69/3632* (2013.01); *A63B 53/14* (2013.01); *A63B 60/22* (2015.10); *A63B 60/24* (2015.10); *A63B 60/32* (2015.10); *A63B 2208/0204* (2013.01); *A63B 2210/50* (2013.01)

(58) Field of Classification Search
CPC ..... A63B 69/36; A63B 60/08; A63B 60/10; A63B 60/12; A63B 60/20; A63B 69/3632; A63B 2208/0204
See application file for complete search history.

(56) References Cited

U.S. PATENT DOCUMENTS 760,161 A * 5/1904 Smith ..... A63B 53/007 473/294
1,648,354 A 11/1927 Lied
(Continued)

FOREIGN PATENT DOCUMENTS

CN 201500420 U 6/2010

OTHER PUBLICATIONS

International Search Report Corresponding to PCT/CA2013/050182 mailed May 29, 2013 4 pages.
(Continued)

*Primary Examiner* — Raleigh W Chiu
(74) *Attorney, Agent, or Firm* — Davis & Bujold PLLC; Michael J. Bujold

(57) ABSTRACT

A golf swing training club for training a golfer has a shaft, a club head with a club face and a gripping area. The club head has a club face for striking a ball. The club head extends out from the shaft in a first direction and the club face facing in a second direction that is perpendicular to the first direction. There is a training grip to be gripped by the dominant hand. The training grip is carried by the shaft and is positioned below the gripping area relative to the club head. The training grip is positioned above the shaft in the direction of the club head and, relative to a direction from the gripping area to the club head, the training grip being angled toward a point that is spaced from the first end of the shaft in each of the first and second directions.

15 Claims, 15 Drawing Sheets

(56) References Cited

U.S. PATENT DOCUMENTS

| | | | | | |
|---|---|---|---|---|---|
| 2,938,728 | A | | 5/1960 | Green | |
| 3,173,689 | A | | 3/1965 | Serblin | |
| 4,252,317 | A | | 2/1981 | Vezina | |
| 4,978,123 | A | * | 12/1990 | Ashihara | A63B 49/08 473/526 |
| 5,009,426 | A | * | 4/1991 | Cox | A63B 69/3632 473/227 |
| 5,328,185 | A | | 7/1994 | Finnigan et al. | |
| 5,458,340 | A | * | 10/1995 | Jackson | A63B 69/3647 473/229 |
| 5,595,385 | A | | 1/1997 | Jablonski | |
| 5,846,143 | A | * | 12/1998 | Brock | A63B 69/3632 473/227 |
| 6,071,199 | A | | 6/2000 | Suzuki | |
| 6,793,589 | B1 | * | 9/2004 | Yerelian | A63B 53/14 473/293 |
| 6,817,956 | B1 | | 11/2004 | Dagenais | |
| 7,160,199 | B1 | * | 1/2007 | Mitchell | A63B 69/0057 473/219 |
| 7,258,622 | B1 | * | 8/2007 | Gaviria | A63B 69/3632 473/219 |
| 7,635,309 | B2 | | 12/2009 | Akavak | |
| 7,658,684 | B2 | | 2/2010 | Ferris | |
| 7,708,651 | B2 | | 5/2010 | Shin | |
| 7,927,236 | B2 | | 4/2011 | Brunton et al. | |
| 8,105,179 | B1 | | 1/2012 | Allen | |
| 2008/0268974 | A1 | | 10/2008 | Brunton et al. | |
| 2009/0069106 | A1 | | 3/2009 | Akavak | |
| 2009/0149268 | A1 | * | 6/2009 | Sison | A63B 69/3632 473/226 |
| 2012/0295724 | A1 | * | 11/2012 | Walker | A63B 69/3632 473/206 |
| 2013/0029778 | A1 | * | 1/2013 | Discolo | A63B 71/0009 473/318 |
| 2014/0100051 | A1 | * | 4/2014 | Dickie | A63B 69/36 473/227 |
| 2015/0273308 | A1 | * | 10/2015 | Paulson | A63B 69/3632 473/226 |

OTHER PUBLICATIONS

Written Opinion Corresponding to PCT/CA2013/050182 mailed May 29, 2013 3 pages.

* cited by examiner

SECTION A–A

SECTION B–B

GOLF SWING TRAINING CLUB

TECHNICAL FIELD

This relates to golf clubs used for training purposes.

BACKGROUND

Golf training clubs are often used to help improve a golfer's swing, or to teach an appropriate swing. U.S. pre-grant publication no. 2012/0295724 (Walker) entitled "Golf club training handle" describes an example of a training club.

SUMMARY

There is provided a golf swing training club for training a golfer comprising a shaft and a club head at a first end of the shaft. The club head has a club face for striking a ball. The club head extends out from the shaft in a first direction and the club face faces in a second direction that is perpendicular to the first direction and toward a target area. There is a gripping area at a second end of the shaft, the first end being below the second end. A training grip to be gripped by the dominant hand is carried by the shaft. The training grip is positioned below the gripping area relative to the club head. The training grip is positioned above the shaft in the direction of the club head and, relative to a direction from the second end toward the first end of the shaft, the training grip being angled toward a point that is spaced from the first end of the shaft in each of the first and second directions.

According to an aspect, the training grip may be angled between 20 and 45 degrees in the first direction and between 20 and 50 degrees in the second direction.

According to an aspect, at least one of the gripping area and the training grip may have a U-shaped bottom surface and a substantially flat upper surface.

According to an aspect, the gripping area may include a non-dominant hand gripping area and a dominant hand gripping area, where the upper surface of the non-dominant hand gripping area is angled away from the target area and the upper surface of the dominant hand gripping area is angled toward the target area. The substantially flat upper surface of the non-dominant hand gripping area may be angled away from the target area at an angle of between 2-10 degrees and the substantially flat upper surface of the dominant hand gripping area is angled toward the target area at an angle of between 5-20 degrees.

According to an aspect, the gripping area may have a non-continuous taper between a non-dominant hand section and a dominant hand gripping area that is below the non-dominant hand gripping area. The dominant hand gripping area may have a reverse taper.

According to an aspect, the training grip may be positioned below a dominant hand position on the shaft.

According to an aspect, the training grip may have a reverse taper.

According to an aspect, at least one of the gripping area and the training grip may include thumb placement markings or contours.

According to an aspect, the training grip may be permanently attached to the shaft.

According to an aspect, the training grip may be attached to the shaft by a connector. The connector may comprises one of a clamp, a clasp, or a latch, or a two part connector, wherein the training grip carries a first part and the shaft carries a second part that receives the first part.

According to an aspect, the training grip may be collapsible and/or pivotable relative to the shaft.

According to an aspect, the club face may have a loft of between 5 and 65 degrees relative to the shaft.

According to another aspect, there is provided a method of hitting a golf ball with a training club held by a user having a dominant hand and a non-dominant hand, the method comprising the steps of: providing a training club as described above; gripping the gripping area with the non-dominant hand and gripping the training grip with the dominant hand; and backswinging to a top of a club stroke and downstroking from the top of the club stroke to contact a golf ball.

According to another aspect, the backswing may be inside the downstroke.

Other aspects will be apparent from the specification and claims below.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 13B is a side elevation view of the golf swing training club with the training grip detached.

DETAILED DESCRIPTION

Figure 1A:
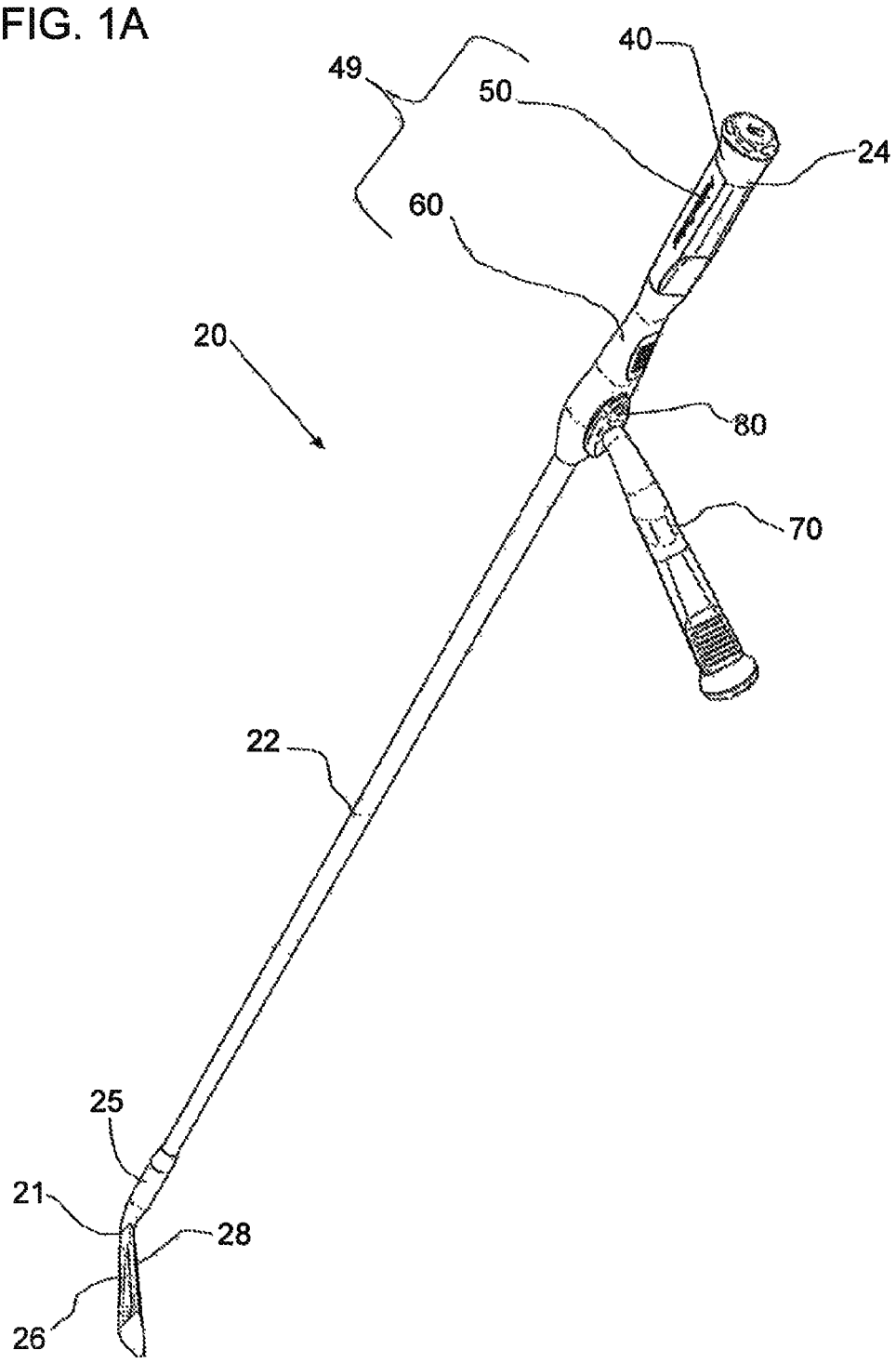
FIG. 1A is a side elevation view of the golf swing training club with the training grip attached.

A golf swing training club generally identified by reference numeral 20, will now be described with reference to FIG. 1 through FIG. 11.

Figure 1B:
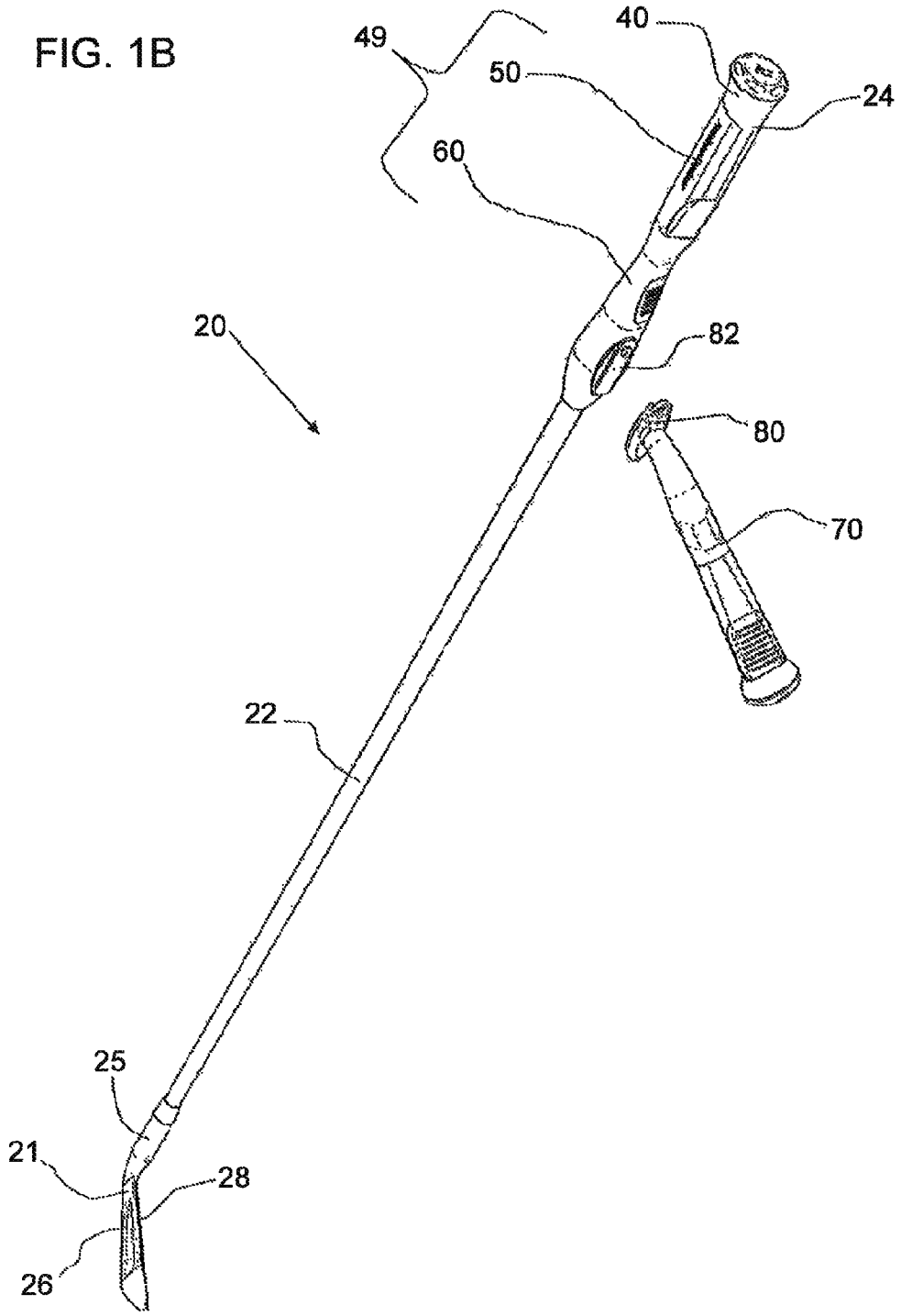
Figure 2A:
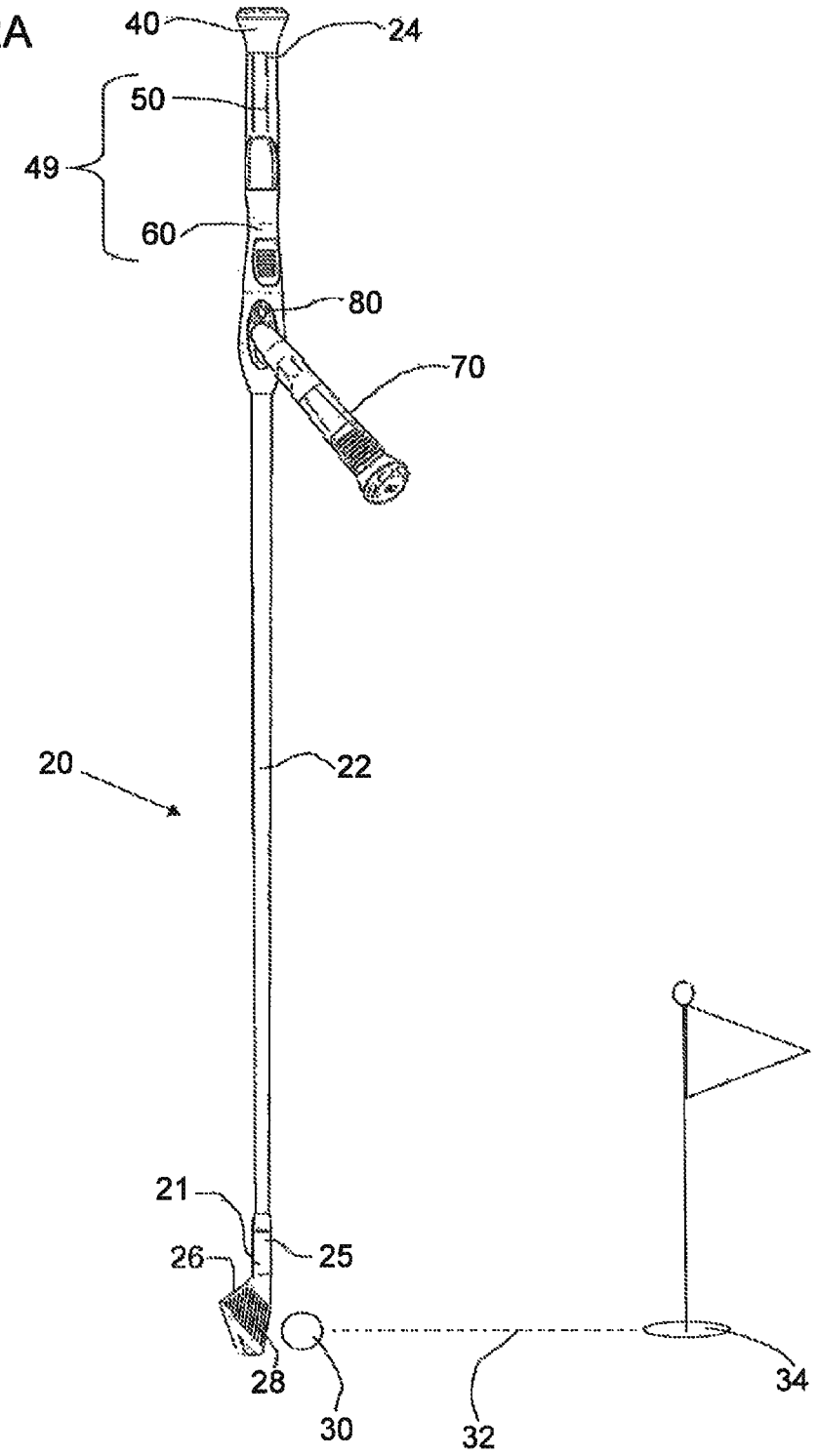
FIG. 2A is a front side elevation view of the golf swing training club with the training grip attached.

Referring to FIGS. 1A and 1B, golf swing training club 20 for training a golfer has a shaft 22. Shaft 22 has a club head 26 with a club face 28 for striking the ball at a first end 21 of shaft 22. Training club 20 is shaped similarly to other clubs and has a club head 26 similar to other club heads on regular golf clubs. As can be seen club head 26 extends out from shaft 22 in a first direction and club face 28 faces in a second direction that is generally perpendicular to the first direction. Referring to FIG. 2A, club face 28 has a flat surface used for striking the golf ball 30 which, if hit correctly, should travel in the intended path of the ball 32 towards a target area 34 in the second direction and toward a target area. Preferably, training club 20 is used on clubs that generally use a full swing, such as drivers, woods, hybrids, irons, wedges, etc. and not generally a putter. For training purposes, training club 20 is preferably an iron. In general, the types of clubs contemplated to be used with training club 20 will have a club face with a loft of between 5 and 65 degrees relative to the shaft, although other lofts may also be used.

Referring again to FIGS. 1A and 1B, shaft 22 has a gripping area 49 at a second end 24 of shaft 22. In this description, first end 21 is considered to be the club end and will be described as below second end 24, or the grip end, as this is the orientation of the club in use. Preferably, gripping area 49 has a dominant hand gripping area 50 and a non-dominant hand gripping area 60. Gripping area 49 may have a known type of grip, or may have a different type of grip to enhance the training aspects of club 20, as will be described in more detail below.

Figure 4A:
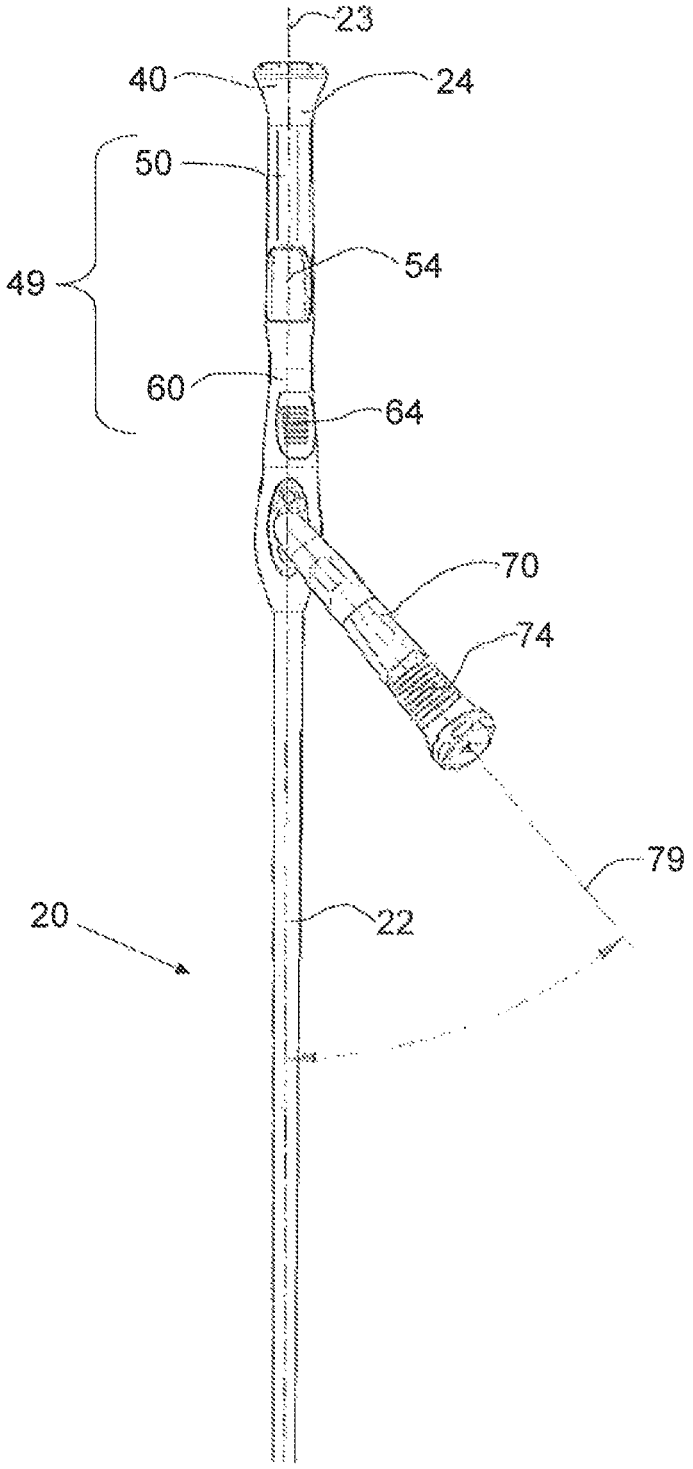
FIG. 4A is a detailed front side elevation view of the second end of the golf swing training club.
Figure 4B:
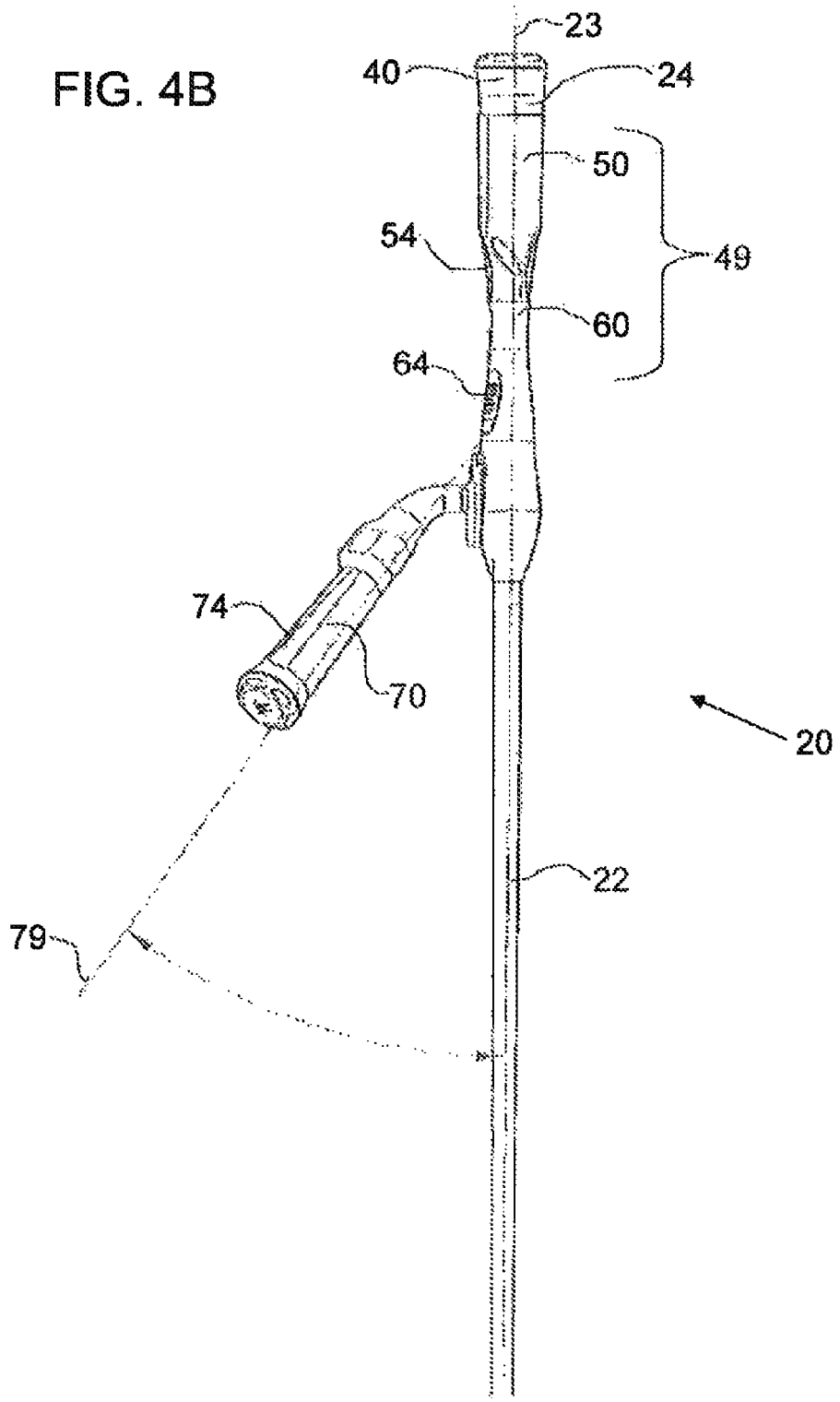
FIG. 4B is a detailed side elevation view of the gripping area of the golf swing training club.
Figure 4C:
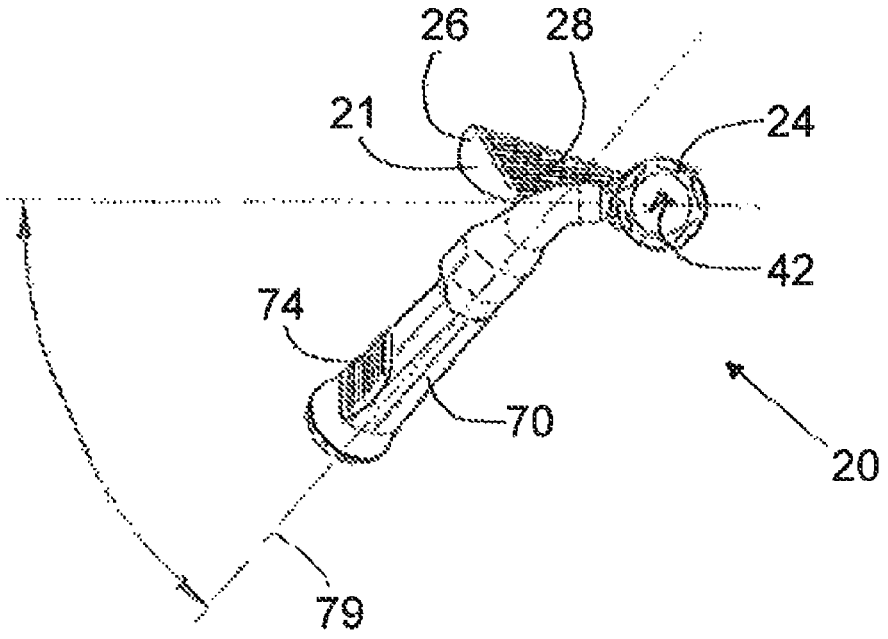
FIG. 4C is an end elevation view of the golf swing training club.

Club 20 also has a training grip 70 to be gripped by the dominant hand of the user. Training grip 70 is carried by shaft 22 and is positioned above shaft 22 in the direction of club head 26 (i.e. perpendicularly away from the axis of shaft 22) and adjacent to and below gripping area 49 relative to club head 26. Referring to FIGS. 4A and 4B, training grip 70 is positioned such that, relative to a direction from second end 24 toward first end 21 of shaft 22, training grip 70 is angled away from shaft 22 toward a point that is spaced from first end 21 of shaft 22 in each of the first and second directions. In other words, when club 20 is held by the user in the normal golfing stance, referring to FIG. 2A, training grip 70 will be above shaft 22 and angled toward the target area 34, such that the user's dominant thumb is above the club and pointing toward the target area 34. Referring again to FIG. 4A-4C, preferably, training grip 70 is angled away from shaft 22 between 20 and 45 degrees in the first direction and between 20 and 50 degrees away from shaft 22 in the second direction. Training grip 70 is also preferably spaced downward from the non-dominant gripping area 60 far enough that the user must move the dominant hand toward club head 26 in order to grip training grip 70 relative to the normal dominant hand position on grip area 49. As training club 20 is designed to be used with training grip 70, it may not be necessary to have a dominant hand grip 50, as this will not be used when the dominant hand is gripping training grip 70. However, it is preferred to also have dominant hand gripping area 50 as it increases the functionality of club 20 as it allows club 20 to be used with a regular swing, and also allows a training grip to be provided to help users learn a proper grip. It will be noted that whether dominant hand grip 50 is present or not will not affect the preferred position of training grip 70 along shaft 22.

Figure 2B:
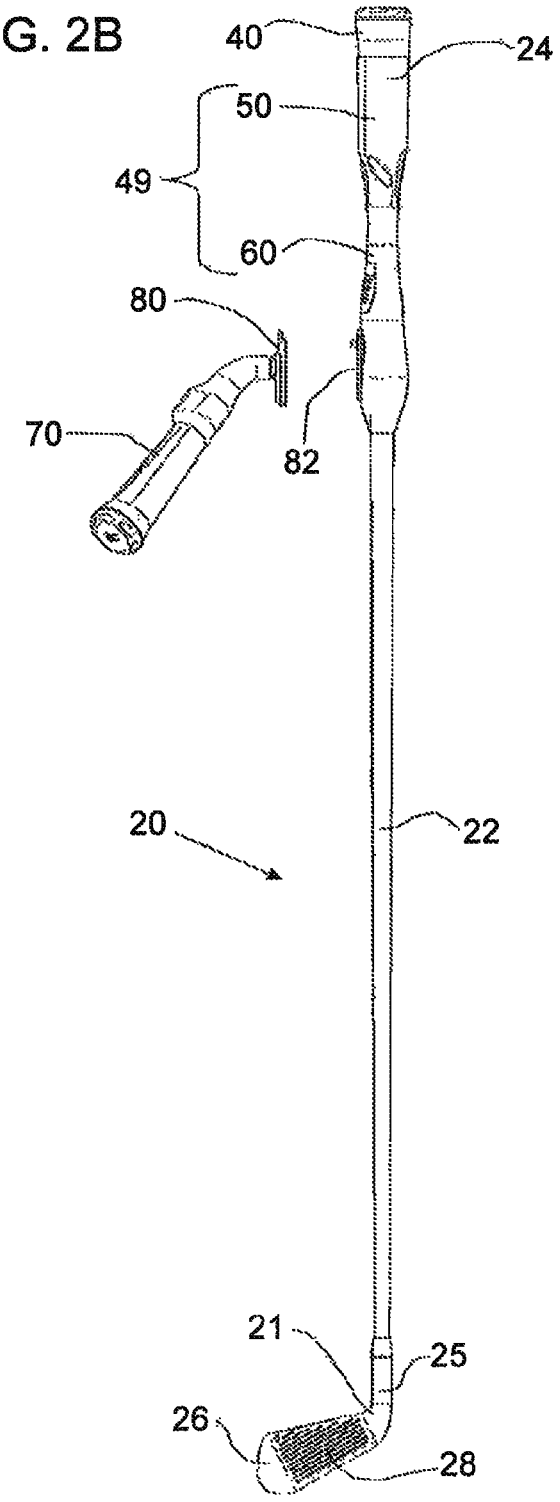
FIG. 2B is a side elevation view of the golf swing training club with the training grip detached.

Training grip 70 may be permanently attached to shaft 22, or it may be removably attached to shaft 22. FIGS. 2A and 2B show a removable training grip attached by a two-part connector, where, referring to FIG. 2B, training grip 70 has a first part 80 of the connector located at one end of training grip 70 and shaft 22 has a second part 82 of the connector located below the gripping area 49. The actual position of first and second parts 80 and 82 may vary, depending on the design of the connectors and club 20. FIGS. 1A and 11B depict club 20 in an embodiment where training grip 70 is attached to club 20 with first part of connector 80 connected to second part of connector 82, locking training grip 70 into place. While a two-part connector is depicted in the drawings, training grip 70 may be attached to shaft 22 using a clamp, a clasp, a latch, or any other known type of attachment. Alternatively, training grip 70 may be attached to shaft 22 in such a way that it is collapsible relative to shaft 22, where training grip 70 is permitted to pivot until it is aligned with shaft 22 and then lowered relative to shaft 22 to allow for easier storage of club 20, or to reduce the risk of training grip 70 interfering with a normal swing.

FIGS. 8A-8F illustrate six different stages of the swing of a golfer using a traditional golf club and FIGS. 9A-9F illustrate six different stages of the swing of a golfer using club 20. The golf swing depicted in FIGS. 8A-8F and the golf swing depicted in FIGS. 9A-9F are both described by stages below.

Figures 8A, 8B, 8C, 8D, 8E, 8F, 9A, 9B, 9C, 9D, 9E, 9F:
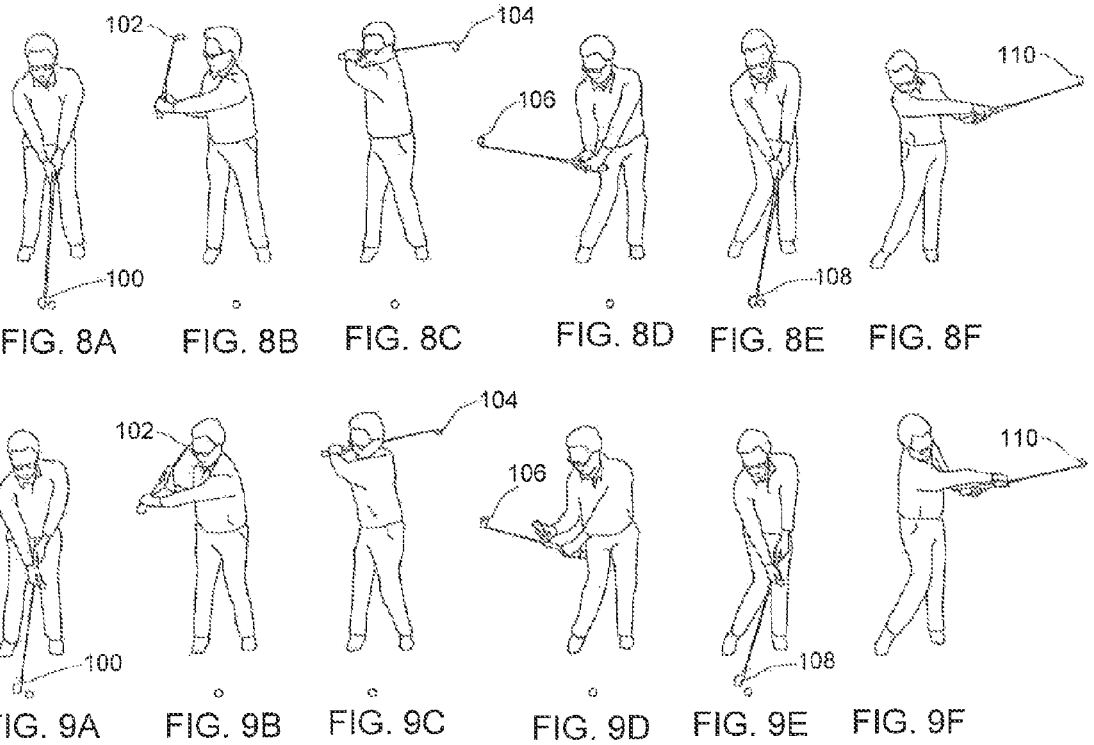
FIG. 8A-8F are a series of diagrams illustrating the different stages of a normal golf swing of a golfer.
FIG. 9A-9F are a series of diagrams illustrating the different stages of a training swing of a golfer while using the golf swing training club.

Both golf swings begin with the address stage 100 shown in FIGS. 8A and 9A. The golfer then begins their backswing and moves to the set stage 102, shown in FIGS. 8B and 9B, which is part way through the back swing. FIGS. 8C and 9C depict the top stage 104 with the club head at the top of the backswing. The golfer then begins their down swing and part way through the down swing is the lag stage 106 as depicted in both FIGS. 8D and 9D. FIGS. 8E and 9E depict the impact stage 108, which includes the moment of contact between club face 28 and golf ball 30. The final stage of the golf swing is the release stage 110 which occurs when club face 28 is released and the forearms cross over on one another depicted in FIGS. 8F and 9F. After this, the golfer's head snaps upward in the finish stage (not shown).

Figure 10:
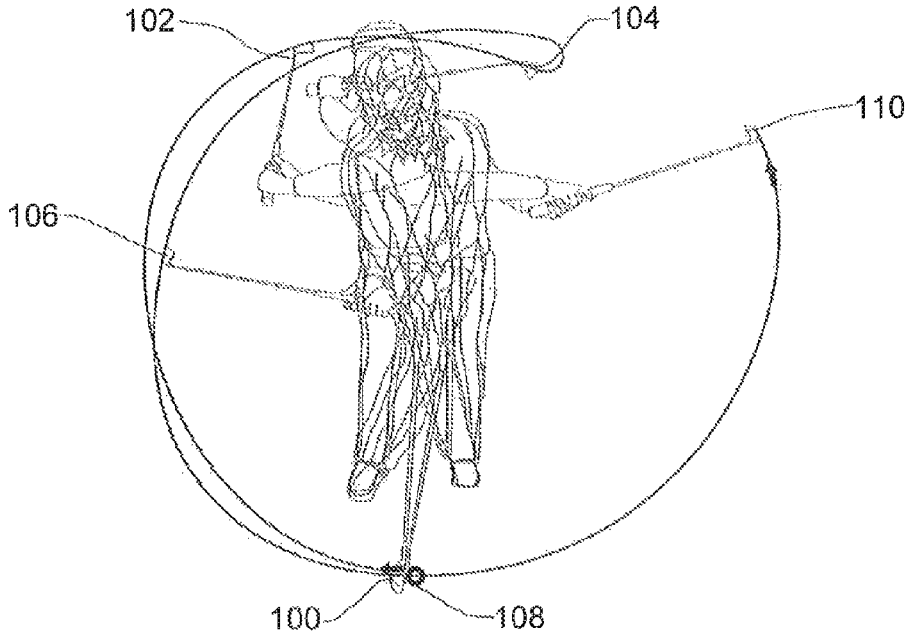
FIG. 10 is a diagram illustrating the different stages of the normal golf swing of a golfer.

FIG. 10 illustrates all six stages of a golf swing using a normal, or ideal, golf swing. The six stages shown are: address 100, set 102, top 104, lag 106, impact 108, and release 110. The travel and the orientation of club face 28 throughout all six stages of the golf swing. During the normal golf swing, the dominant and non-dominant hands of the golfer are in contact with each.

The normal golf swing is a representation of the ideal swing or movement sequence of club head 26 and the golfer's body. However, this golf swing is difficult, complicated, and also requires a much faster swing motion by the golfer (i.e. progression through the six stages) in order to execute this golf swing correctly as compared to a training swing depicted in FIG. 11 using training club 20. It should also be noted that the path of club head 26, shown by curved line, travels in a larger arc in the normal swing of FIG. 10 compared to the smaller are of the curved line of the training swing depicted in FIG. 11.

Referring to FIG. 10, starting at address 100, club head 26 is moving inside (i.e. closer to the golfer) to set 102, at which point club head 26 transitions outside (i.e. further from the golfer) until, just before club 20 is parallel or horizontal, it transitions inside again and reaches top 104. Then club head 26 transitions back outside for a short distance before transitioning back inside just before reaching lag 106. From the beginning of lag 106 until just before impact 108, club head 26 transitions outside. Club head 26 remains outside for the remainder of the swing to and beyond release 110.

Figure 11:
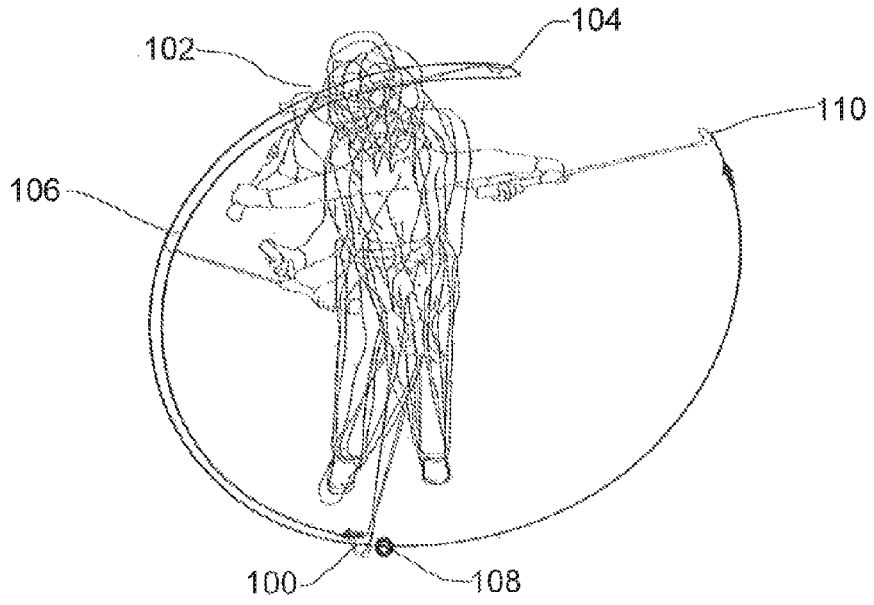
FIG. 11 is a diagram illustrating the different stages of a training swing of a golfer while using the golf swing training club.

FIG. 11 illustrates all six stages of a golf swing using club 20. The six stages shown are: address 100, set 102, top 104, lag 106, impact 108, and release 110. The curved line in FIG. 11 also depicts the path of travel and the orientation of club face 28 throughout all six stages of the golf swing with club 20. During the golf swing with club 20, the dominant and non-dominant hands of the golfer are not in contact with each other throughout the entire swing.

The training golf swing of FIG. 11 is slower, easier, and relatively simple compared to the swing in FIG. 10. During a training golf swing using club 20, club head 26 travels through an inside sequence (i.e. closer to the golfer) from address 100 through set 102 and moving to top 104. Club head 26 then moves outside (i.e. further from the golfer) from top 104 through lag 106, impact 108, and release 110. It should also be noted that the path of club head 26 travels in a smaller are in FIG. 11 compared to the larger arc of the swing depicted in FIG. 10. At no point during the swing in FIG. 10 or the swing with club 20 in FIG. 11 does the path of club head 26 cross over or under the curved line on the way to top 104 or from the top 104 to impact 108. Club head 26 follows an inside then outside movement sequence during both swings. It should be noted that club head 26 is closer to the golfer's body at release 110 compared to release 110 using the normal swing illustrated in FIG. 10.

Figure 5A:
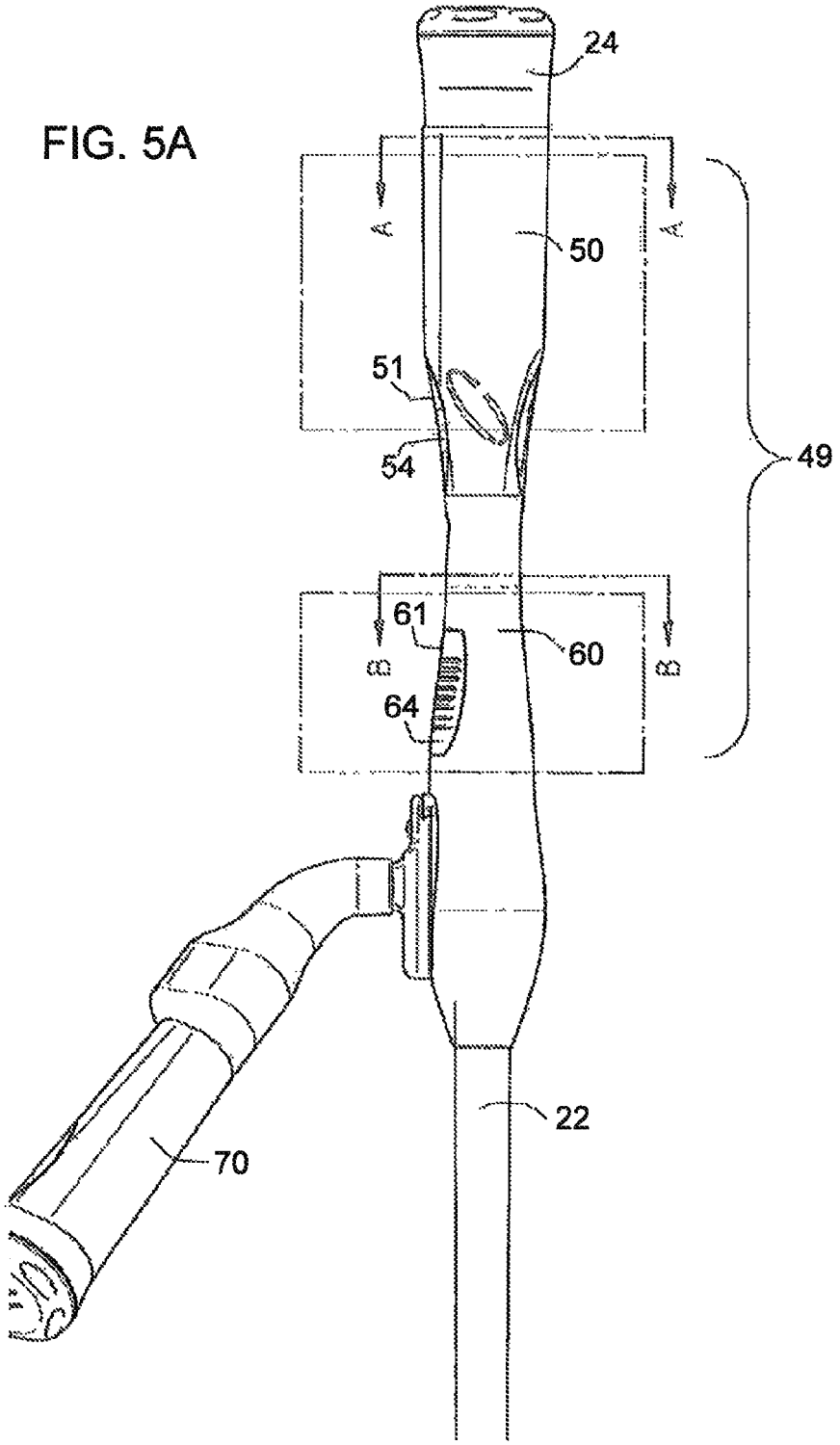
FIG. 5A is a side view in section of the gripping area.
Figure 5B:
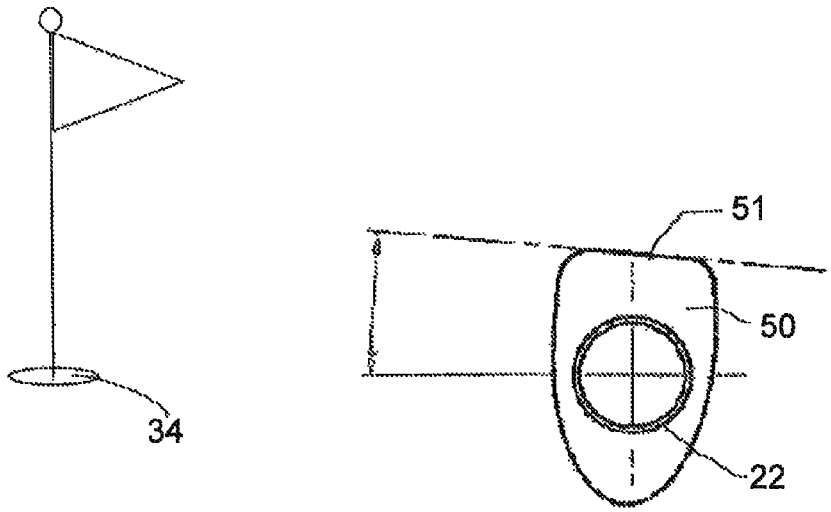
FIG. 5B is an end elevation view of the non-dominant hand gripping areas along section lines A-A in FIG. 5A.
Figure 5C:
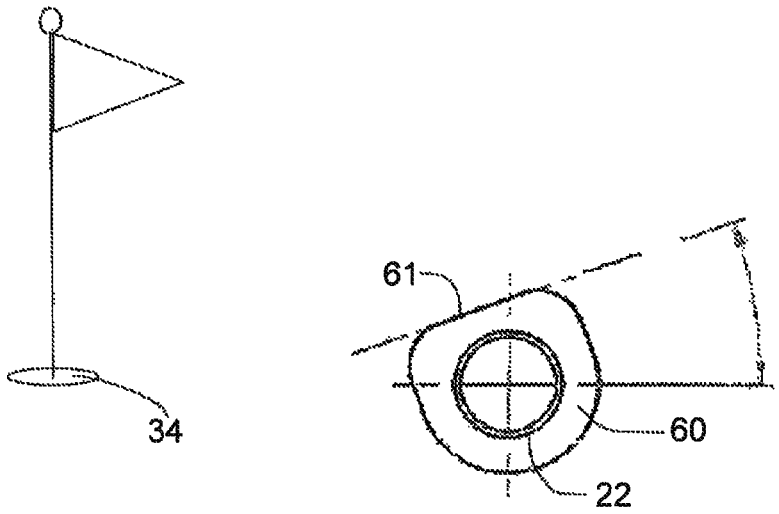
FIG. 5C is an end elevation view of the dominant hand gripping areas along section lines B-B in FIG. 5A.
Figure 6A:
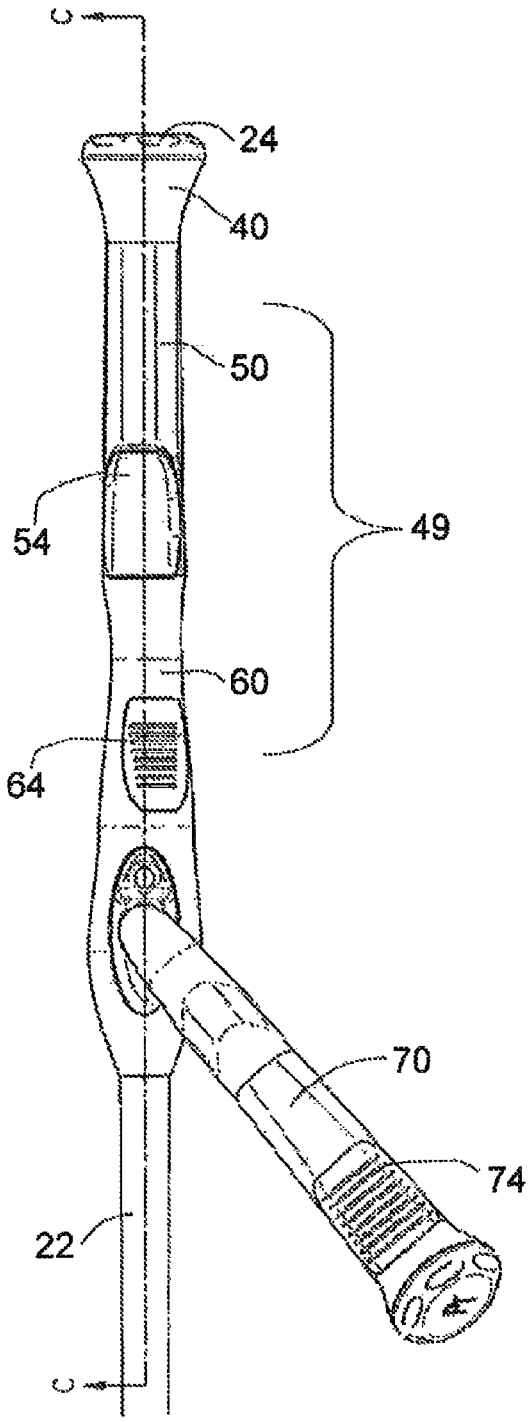
FIG. 6A is a detailed side elevation view of the gripping area and training grip.

As mentioned above, club 20 may also be designed to train a user to improve their grip. In one example, referring to FIGS. 5A, 5B and 5C, non-dominant hand grip 50 and dominant hand grip 60 may have U-shaped cross-sections with a flat upper surface where the thumb is generally placed. Referring to FIG. 5A, non-dominant hand grip 50 and dominant hand grip 60 have areas for the correct placement of the golfer's thumbs. In one example, non-dominant hand gripping area 50 has a non-dominant hand thumb placement pad 54 and dominant hand gripping area 60 has a dominant hand thumb placement pad 64. This guides a user to a proper hand position on gripping area 49, with the understanding that, with proper thumb placement, the fingers will follow. In addition to thumb pads, the grip may be shaped or marked in other ways to help guide the finger position of the user, such as with lines to show thumb and/or finger position, or bumps and grooves to urge thumb, finger and/or heel of the hand into the proper position. Referring to FIG. 6A, the training grip 70 may also have a training grip thumb placement pad 74. In addition to proper thumb and finger position, the U-shaped cross section of each of the grips 50 and 60 may be angled relative to each other to ensure a proper or exaggerated overlap between the hands. As shown, referring to FIG. 5B, the upper surface of non-dominant hand grip 50 may be angled away from the target area 34 (shown in FIG. 2A), or clockwise from the top of the grip at an angle of, for example, 2 to 10 degrees while upper surface of the dominant hand grip 60 is angled towards the target area 34, or counter-clockwise from the top of the grip at an angle of, for example, 5 to 20 degrees.

Figure 6B:
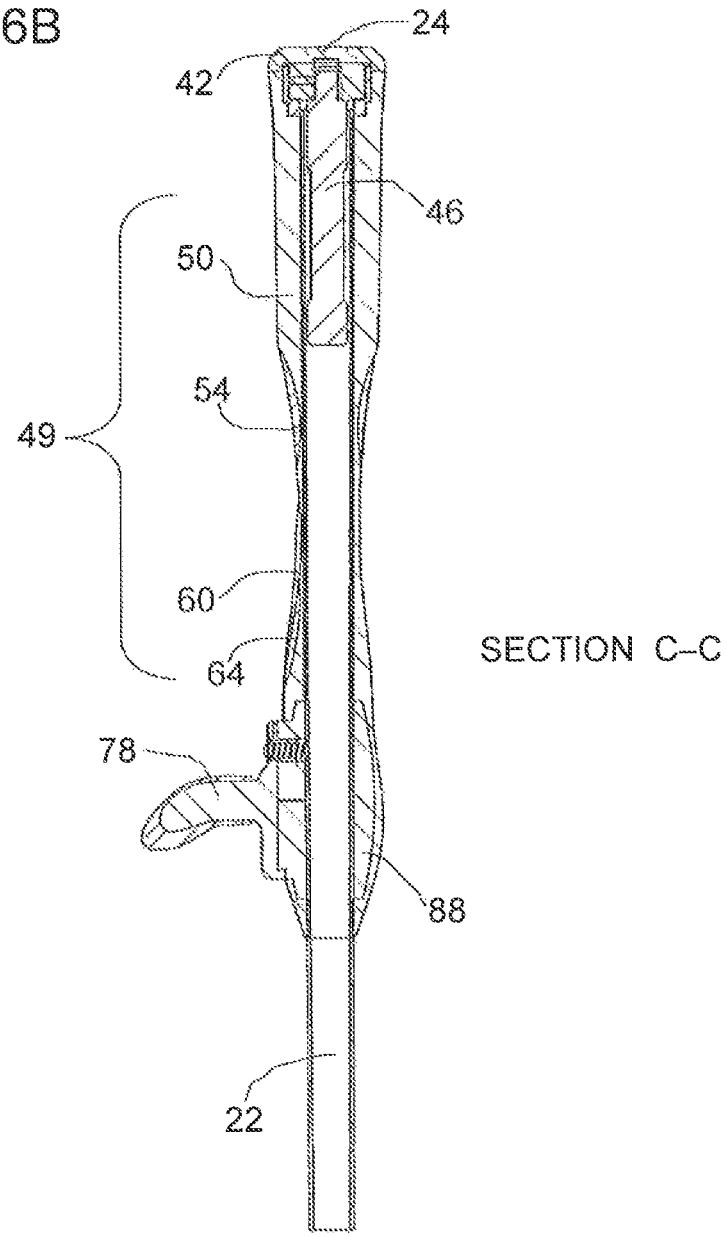
FIG. 6B is a detailed side elevation view in section of the gripping area along section lines C-C in FIG. 6A.
Figure 7A:
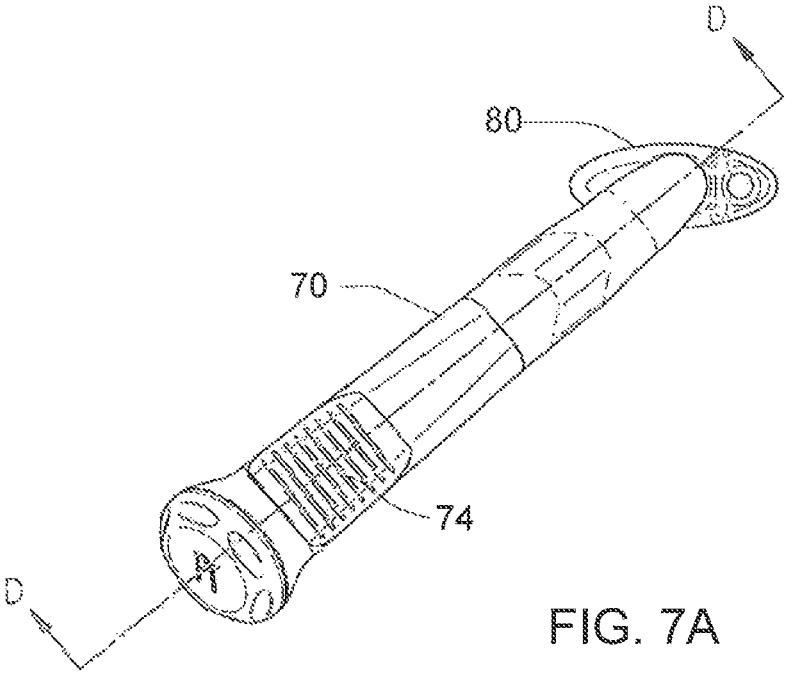
FIG. 7A is a top plan view of the training grip.
Figure 7B:
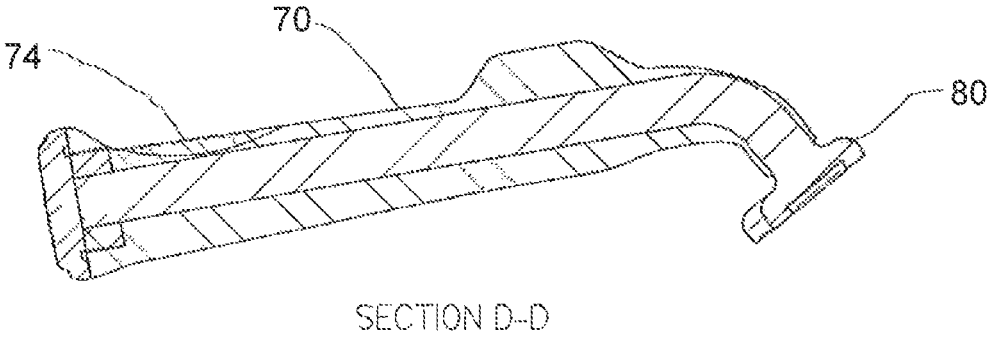
FIG. 7B is a side elevation view in section of the training grip along section lines D-D in FIG. 7A.

In another example, the various gripping areas may have tapers and contours along the axis to help improve the user's grip of the club. As shown in FIGS. 6A and 6B, gripping area 49 has a non-continuous taper between non-dominant hand section 50 and dominant hand gripping area 60. As can be seen, dominant hand gripping area 60 has a reverse taper, i.e. it gets larger moving down the grip, while the non-dominant hand gripping area 50 has a relatively continuous, gradual taper at the top end that develops a sharper slope as it joins with dominant hand gripping area 60. As shown in FIG. 6A, training grip 70 may also have a reverse taper.

Figure 3:
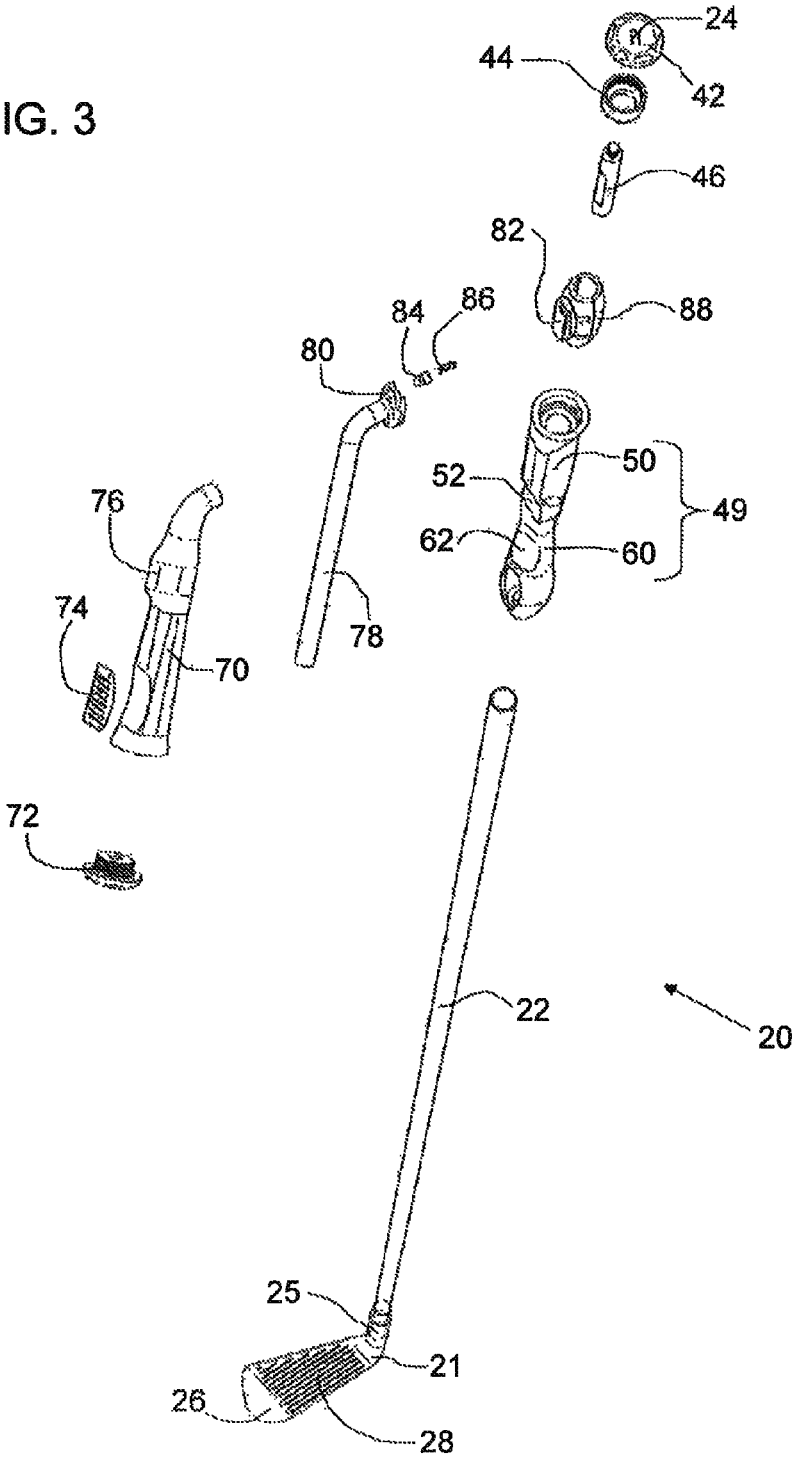
FIG. 3 is an exploded perspective view of the golf swing training club.

FIG. 3 is an exploded view of the golf swing training club. The club head 26 which has a club face 28 is attached to the shaft 22 at a first end by a hosel 25. The shaft extends towards a second end 24 that has a gripping area 49 which has a dominant hand gripping area 60 and a non-dominant hand gripping area 50. The gripping area has areas specifically for the correct placement of the golfer's thumbs. The non-dominant hand gripping area 50 has a non-dominant hand thumb placement area 52 underneath a non-dominant hand thumb placement pad 54. The dominant hand gripping area 60 has a dominant hand thumb placement area 62 underneath a dominant hand thumb placement pad 64. The first end of the shaft 22 has a shaft bolt 46 that may be designed with sufficient weight to act as a counterweight which helps the golfer have the correct backswing motion of their golf swing. Those skilled in the art will be able to determine an appropriate weight ratio between the club and the counterweight to achieve the desired result. The shaft bolt 46 extends through the counterweight cap connector 44 and connects the shaft 22 to the counterweight cap 42 which is located at the second end of the golf swing training club 20.

In FIG. 3, the first part of connector 80 at the end of the training grip shaft 78 attaches to the second part of connector 82 which is exposed through a hole near the first end of the dominant hand gripping area 60. The second part of connector 82 is attached to the second part of connector housing 88 which encircles a part of the shaft 22 underneath the dominant hand gripping area. The second part of connector housing also contains a connector spring 86 which is covered by a connector button 84. In one example, the golfer pushes down on the connector button 84 and slides the training grip 70 towards the first end to detach the training grip. In the same example, the golfer would line up the first part of connector 80 of the training grip 70 below the second part of the connector 82 and slide the training grip in the direction of the second end of the golf swing training club until the training grip is locked in place by the connector button 84 through a hole in the first part of connector 80. The training grip shaft 78 is enveloped by the training grip 70 which extends away from the first part of connector 80 and after a curved part has a training grip raised area 76 which is shaped in such a way as to mimic the thumb of the non-dominant hand of the golfer. The training grip also has a training grip thumb placement pad 74. In the depicted example, the training grip is designed to be gripped in such way that the thumb of their dominant hand is on the training grip thumb placement pad 74. The end of the training grip 70 that is away from the first part of connector 80 has a training grip cap 72.

FIGS. 4A and 4B depict second end 24 of the golf swing training club including the non-dominant hand gripping area 50 and the dominant hand gripping area 60 on the shaft 22 and the training grip 70 which is attached to shaft 22 below the dominant hand gripping area 60. In full-swing mode, the golfer places the thumb of their non-dominant hand on the non-dominant hand thumb placement pad 54 and the thumb of their dominant hand on the dominant hand thumb placement pad 64 after they have the correct grip club 20. In training mode, the golfer places the thumb of their non-dominant hand on the non-dominant hand thumb placement pad 54 and the thumb of their dominant hand on the training grip thumb placement pad 74. The training grip is angled in the direction of the target area 34 (shown in FIG. 2A), such that the angle between the axis of the shaft 23 and the axis of the training grip 79 is 20 to 50 degrees as shown in FIG. 4A. Referring to FIG. 4B, the training grip is angled away from the shaft in the direction of the club head, such that the angle between the axis of the shaft 23 and the axis of the training grip 79 is 20 to 45 degrees. The combination of the angles shown in FIG. 4A and FIG. 4B determine the orientation of training grip 70 relative to shaft 22.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples above.

What is claimed is:

1. A golf swing training club for training a golfer comprising:

a shaft;

a club head at a first end of the shaft, the club head having a club face for striking a ball, the club head extending out from the shaft in a first direction and the club face facing in a second direction that is perpendicular to the first direction and toward a target area;

a gripping area at a second end of the shaft, the first end being below the second end; and a training grip to be gripped by the dominant hand, the training grip being carried by the shaft, the training grip being positioned below the gripping area relative to the club head, the training grip being positioned above the shaft in the direction of the club head and, relative to a direction from the second end toward the first end of the shaft, the training grip being angled toward a point that is spaced from the first end of the shaft in each of the first and second directions.

2. The golf swing training club of claim 1 wherein the training grip is angled between 20 and 45 degrees in the first direction and between 20 and 50 degrees in the second direction.

3. The golf swing training club of claim 1 wherein at least one of the gripping area and the training grip has a U-shaped bottom surface and a substantially flat upper surface.

4. The golf swing training club of claim 3 wherein the gripping area includes a non-dominant hand gripping area and a dominant hand gripping area, where the upper surface of the non-dominant hand gripping area is angled away from the target area and the upper surface of the dominant hand gripping area is angled toward the target area.

5. The golf swing training club of claim 4, wherein the substantially flat upper surface of the non-dominant hand gripping area is angled away from the target area at an angle of between 2-10 degrees and the substantially flat upper surface of the dominant hand gripping area is angled toward the target area at an angle of between 5-20 degrees.

6. The golf swing training club of claim 1 wherein the gripping area has a non-continuous taper between a non-dominant hand section and a dominant hand gripping area that is below the non-dominant hand gripping area.

7. The golf swing training club of claim 6, wherein the dominant hand gripping area has a reverse taper.

8. The golf swing training club of claim 1 wherein the training grip is positioned below a dominant hand position on the shaft.

9. The golf swing training club of claim 1 wherein the training grip has a reverse taper.

10. The golf swing training club of claim 1 wherein at least one of the gripping area and the training grip includes thumb placement markings or contours.

11. The golf swing training club of claim 1 wherein the training grip is permanently attached to the shaft.

12. The golf swing training club of claim 1 wherein the training grip is attached to the shaft by a connector.

13. The golf swing training club of claim 12, wherein the connector comprises one of a clamp, a clasp, or a latch, or a two part connector, wherein the training grip carries a first part and the shaft carries a second part that receives the first part.

14. The golf swing training club of claim 1 wherein the training grip is collapsible relative to the shaft.

15. The golf swing training club of claim 1 wherein the club face has a loft of between 5 and 65 degrees relative to the shaft.

* * * * *